US011791563B1

(12) United States Patent
Zhang et al.

(10) Patent No.: US 11,791,563 B1
(45) Date of Patent: Oct. 17, 2023

(54) DEPLOYABLE MESH ANTENNA BASED ON DOME-TYPE TENSEGRITY

(71) Applicant: Xidian University, Xi'an (CN)

(72) Inventors: Yiqun Zhang, Xi'an (CN); Shunchang Liu, Xi'an (CN); Jianguo Cai, Xi'an (CN); Meng Li, Xi'an (CN); Yiduo Quan, Xi'an (CN); Zihan Sun, Xi'an (CN); Peng Cao, Xi'an (CN); Zhiyuan Li, Xi'an (CN)

(73) Assignee: XIDIAN UNIVERSITY, Xi'an (CN)

( * ) Notice: Subject to any disclaimer, the term of this patent is extended or adjusted under 35 U.S.C. 154(b) by 0 days.

(21) Appl. No.: 18/305,339

(22) Filed: Apr. 22, 2023

(30) Foreign Application Priority Data

Apr. 24, 2022 (CN) ..... 202210454969.0

(51) Int. Cl.
*H01Q 15/16* (2006.01)
*H01Q 1/42* (2006.01)

(52) U.S. Cl.
CPC ..... *H01Q 15/168* (2013.01); *H01Q 1/42* (2013.01)

(58) Field of Classification Search
CPC .... H01Q 15/16; H01Q 15/161; H01Q 15/168; H01Q 15/20; H01Q 1/42
See application file for complete search history.

(56) References Cited

U.S. PATENT DOCUMENTS 10,256,530 B2 * 4/2019 Freebury ..... H01Q 1/288

FOREIGN PATENT DOCUMENTS

| | | | | |
|---|---|---|---|---|
| CN | 109638470 A | * | 4/2019 | ..... H01Q 15/161 |
| CN | 114628879 A | * | 6/2022 | ..... H01Q 1/08 |
| EP | 807991 A1 | * | 11/1997 | ..... H01Q 15/161 |
| EP | 2626951 A1 | * | 8/2013 | ..... H01Q 1/288 |

OTHER PUBLICATIONS

CNIPA, Notification of a First Office Action for CN202210454969.0, dated Oct. 27, 2022.
Xidian University (Applicant), Reply to Notification of a First Office Action for CN202210454969.0, w/ (allowed) replacement claims, dated Dec. 7, 2022.
CNIPA, Notification to grant patent right for invention in CN202210454969.0, dated Jan. 18, 2023.

* cited by examiner

*Primary Examiner* — Hoang V Nguyen
(74) *Attorney, Agent, or Firm* — Zhigang Ma

(57) ABSTRACT

A deployable mesh antenna based on dome-type tensegrity includes: a wire mesh reflector, a dome-type reflector support system, and a peripheral deployable truss which are coaxially arranged; the peripheral deployable truss includes: a annular main rod and end-to-end truss units disposed on the main rod; an outermost cable boundary of the dome-type reflector support system is fixedly connected to the peripheral deployable truss, and the dome-type reflector support system includes: an inner strut ring, an outer circumference of the inner strut ring is connected to radial rib units, each radial rib unit is arranged at a radial direction of the inner strut ring, and the radial rib units are connected through hoop cables; the wire mesh reflector is covered on the dome-type reflector support system to form a parabolic structure, the wire mesh reflector is petal-shaped, and the wire mesh reflector has a grid structure.

2 Claims, 4 Drawing Sheets

DEPLOYABLE MESH ANTENNA BASED ON DOME-TYPE TENSEGRITY

TECHNICAL FIELD

The disclosure relates to the technical field of spaceborne deployable antennas, in particular to a deployable mesh antenna based on dome-type tensegrity.

BACKGROUND

Space deployable antennas are an important part of spacecraft, widely used in communication, national defense, deep space exploration, navigation and other fields. With the continuous development of space technology and limited by a carrying capacity of carrier rockets, the space-borne deployable antennas are developing towards a direction of high precision, large aperture, high deploy/stow ratio and light mass. The deployable antenna with lighter-mass and smaller storage volume can effectively save the launching cost of spacecraft.

In the related art, a reflector support structure of the space-borne deployable mesh antenna is generally composed of a double-layer back cable net, which leads to the need to design a higher deployable height to meet the deployment height and volume of the double-layer back cable net when designing the peripheral truss, which is no different from increasing the mass and volume of the whole antenna when it is stowed, and aggravating the burden of the carrier rocket.

SUMMARY

The purpose of the disclosure is to provide a deployable mesh antenna based on dome-type tensegrity, which combines a wire mesh and a deployable truss to form a deployable antenna structure, thus meeting the requirements of high deploy/stow ratio, light mass and large aperture.

The technical solution of the disclosure is as follows. A deployable mesh antenna based on dome-type tensegrity includes: a wire mesh reflector, a dome-type reflector support system, and a peripheral deployable truss which are coaxially arranged.

The peripheral deployable truss includes: an annular main rod and a plurality of truss units disposed on the main rod, and the plurality of truss units are connected end to end.

An outermost cable boundary of the dome-type reflector support system is fixedly connected to the peripheral deployable truss, the dome-type reflector support system includes: an inner strut ring and a plurality of radial rib units connected to an outer circumference of the inner strut ring, each radial rib unit is arranged at a radial direction of the inner strut ring, and the plurality of radial rib units are connected through hoop cables.

The wire mesh reflector is covered on the dome-type reflector support system to form a parabolic structure, the wire mesh reflector is petal-shaped and has a grid structure.

The characteristics of the disclosure also lie in the following content.

The inner strut ring includes a plurality of inner ring rods parallel to one another and distributed in a circular shape, top ends of the plurality of inner ring rods are connected in series through a cable, and bottom ends of the plurality of inner ring rods are connected in series through a cable.

Each radial rib unit includes a plurality of back cables arranged at a same straight line, the plurality of back cables are sequentially connected with the bottom end of a corresponding one of the plurality of inner ring rods, the plurality of back cables are located at a radial direction of a ring surrounded by the bottom ends of the plurality of inner ring rods; an end of each back cable facing away from the corresponding inner ring rod is provided with a strut, a bottom end of the strut is fixedly connected to the back cable, and two adjacent struts in the same radial rib unit are connected through an diagonal cable, and the top end of the inner ring rod and the bottom end of the strut closest to the inner ring rod are connected through a diagonal cable.

In the two adjacent struts of the same radial rib unit, the top end of the strut closer to the inner strut ring is connected with an end of the diagonal cable, and the bottom end of the strut farther away from the inner strut ring is connected with another end of the diagonal cable.

A distance between the two adjacent struts in the same radial rib unit increases outward from the inner strut ring, and a length of the strut in the same radial rib unit increases outward from the inner strut ring, the top ends of the struts in the plurality of radial rib units fall on a same paraboloid, and the top ends of the struts located on a same circumference in the plurality of radial rib units are connected in series by the hoop cable.

Each truss unit includes a retractable lower sleeve rod connected with the main rod, and further includes a left half unit and a right half unit which take the retractable lower sleeve rod as an axis and are in an axisymmetric structure; the left half unit includes a retractable upper sleeve rod, an upper auxiliary rod, a connecting rod and a lower auxiliary rod connected sequentially in that order; two ends of the retractable upper sleeve rod are respectively hinged with an end of the upper auxiliary rod and the main rod, another end of the upper auxiliary rod is hinged with the main rod, two ends of the retractable lower sleeve rod are respectively hinged with the main rod and an end of the lower auxiliary rod, an end of the connecting rod is hinged on a middle of the upper auxiliary rod, another end of the lower auxiliary rod is hinged with another end of the connecting rod, a position of one third of a length of the lower auxiliary rod is hinged with the main rod, the retractable upper sleeve rod and the retractable lower sleeve rod are located on upper and lower sides of the main rod, and the retractable upper sleeve rod and the retractable lower sleeve rod are parallel to the strut, the upper auxiliary rod of the left half unit is hinged with the upper auxiliary rod of the right half unit in the adjacent truss unit; the retractable upper sleeve rods connected by the two hinged upper auxiliary rods are the same retractable upper sleeve rod, and hinged positions of the two hinged upper auxiliary rods and the retractable upper sleeve rod are the same hinged point.

The peripheral deployable truss is provided with a driving cable passing through the plurality of truss units individually; in the left half unit of each truss unit, a connection position of the retractable upper sleeve rod and the main rod, a connection position of the retractable upper sleeve rod and the upper auxiliary rod, a connection position of the upper auxiliary rod and the main rod, a connection position of the retractable lower sleeve rod and the main rod, and a connection position of the retractable lower sleeve rod and the lower auxiliary rod are respectively provided with fixed pulleys; in the right half unit of each truss unit, a connection position of the retractable upper sleeve rod and the main rod, a connection position of the retractable upper sleeve rod and the upper auxiliary rod, a connection position of the upper auxiliary rod and the main rod, and a connection position of the lower auxiliary rod and the main rod are respectively provided with fixed pulleys; the driving cable passes through the upper auxiliary rod and successively bypasses the fixed pulleys of the truss unit, and the driving cable is set in a same way in the plurality of truss units; and two ends of the driving cable are connected to a motor.

A center of the wire mesh reflector is provided with a center opening matching with the inner strut ring, the center opening is fixed connected with the top ends of the plurality of inner ring rods, grids of the wire mesh reflector are radially distributed around the center opening, and sizes of the grids increase from the center opening to an outer edge of the wire mesh reflector, and each grid is isosceles trapezoid, and upper and lower bottom edges of the isosceles trapezoid grid are respectively fixed on two adjacent hoop cables.

The outer edge of the wire mesh reflector is provided with a tension cable, the tension cable is arranged in multiple V-shapes, the multiple V-shapes are sequentially connected along an outline of the outer edge of the wire mesh reflector, and a V-shaped connection point of each V-shape of the tension cable is fixed at a connection point of the two upper auxiliary rods of the peripheral deployable truss.

The number of the struts in each radial rib unit is Q, Q represents the number of rings formed by the struts in the dome-type reflector support system, the number of the plurality of radial rib units is N; and Q and N are selected according to a surface accuracy root-mean-square (RMS) of the wire mesh reflector and an overall mass M of the dome-type reflector support system, and Q and N are obtained through the following steps.

Step 1, for given design parameters of the deployable mesh antenna: an aperture D, a focal length f, —and a surface precision RMS, calculating surface accuracy of the wire mesh reflector under different ring numbers Q and different rib numbers N, and selecting the ring numbers Q and the rib numbers N corresponding to the surface accuracy RMS that meets design requirements.

Step 2, calculating overall mass M of the dome-type reflector support system under the selected ring numbers Q and selected rib numbers N in step 1, and selecting the ring number Q and the rib number N corresponding to the overall mass M that meets design requirements, which are the number Q of the struts in each radial rib unit and the number N of the plurality of radial rib units in the deployable mesh antenna.

The disclosure has the beneficial effects as follows.

(1) The dome-type reflector support system of the deployable mesh antenna based on dome-type tensegrity is an internal force balance structure composed of a large number of cables and a small number of rods, which can effectively reduce the mass and storage volume of the deployable antenna. The internal force balance structure composed of the tensegrity structure and the peripheral deployable truss will be an ideal choice for the future large space-borne deployable antenna.

(2) The disclosure selects a single-layer dome-type reflector support structure to replace the traditional double-layer reflector support structure in the tensegrity structure, so that only one circle of hanging points is needed for the border of the designed peripheral deployable truss, and the deploy/stow ratio of the deployable truss is higher, and the stowed volume is smaller and the mass are lighter.

(3) The dome-type reflector support system is in a relaxed state without pretension, and the peripheral deployable truss provides boundary support for the system and generate structural stiffness after the peripheral deployable truss is deployed, which makes the deployable mesh antenna based on the dome-type tensegrity structure have good structural stiffness during operation.

(4) The deployable mesh antenna based on dome-type tensegrity can be used in the design of a large antenna.

DESCRIPTION OF REFERENCE SYMBOLS

1: wire mesh reflector;
2: dome-type reflector support system;
3: peripheral deployable truss;
4: inner strut ring;
5: strut;
6: back cable;
7: hoop cable;
8: diagonal cable;
9: retractable upper sleeve rod;
10: main rod;
11: lower auxiliary rod;
12: retractable lower sleeve rod;
13: connecting rod;
14: upper auxiliary rod;
15: fixed pulley;
16: driving cable;
17: tension cable.

DETAILED DESCRIPTION OF EMBODIMENTS

The disclosure will be described in detail with reference to the attached drawings and specific embodiments.

Figure 1:
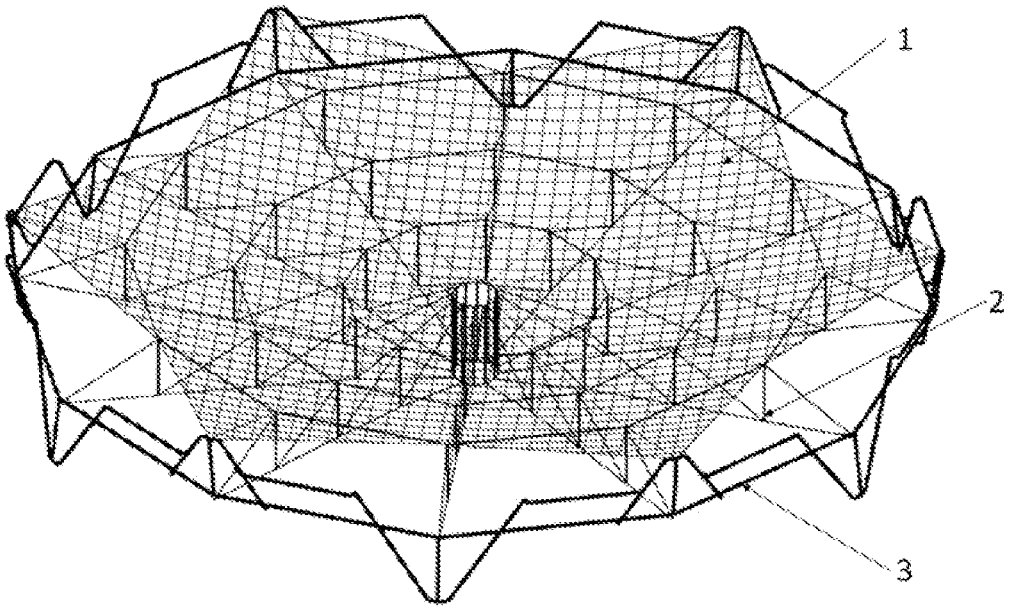
FIG. 1 illustrates a schematic structural diagram of a deployable mesh antenna based on dome-type tensegrity according to an embodiment of the disclosure.

The disclosure provides a deployable mesh antenna based on dome-type tensegrity, as shown in FIG. 1, the deployable mesh antenna based on dome-type tensegrity includes a wire mesh reflector 1, a dome-type reflector support system 2, and a peripheral deployable truss 3, which are coaxially arranged. Boundary joints required by the dome-type reflector support system 2 are provided by the peripheral deployable truss 3, and an outermost cable boundary of the dome-type reflector support system 2 is fixedly connected to the peripheral deployable truss 3. The stowed wire mesh reflector 1 and the dome-type reflector support system 2 are disposed inside the stowed peripheral deployable truss 3, the peripheral deployable truss 3 can drive the dome-type reflector support system 2 to deploy when the peripheral deployable truss 3 is deployed, and provide support for the dome-type reflector support system 2 to form the dome-type reflector support system 2.

Figure 2:
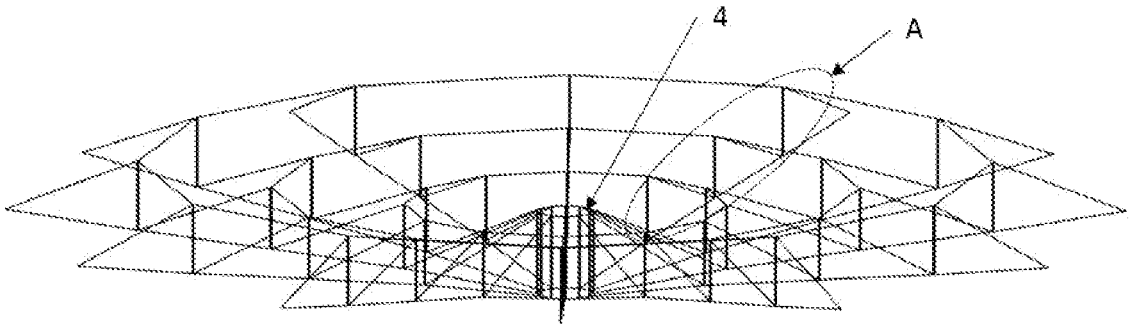
FIG. 2 illustrates a schematic structural diagram of a dome-type reflector support system of the deployable mesh antenna based on dome-type tensegrity according to an embodiment of the disclosure.

The outermost cable boundary of the dome-type reflector support system 2 is fixedly connected to the peripheral deployable truss 3. As shown in FIG. 2, the dome-type reflector support system 2 includes an inner strut ring 4 and multiple radial rib units connected to an outer circumference of the inner strut ring 4, each radial rib unit is located in a radial direction of the inner strut ring 4, and the radial rib units are connected by hoop cables 7.

The inner strut ring 4 includes multiple inner ring rods which are parallel to one another and distributed in a circular shape, top ends of the inner ring rods are connected in series through a cable, and bottom ends of the inner ring rods are connected in series through a cable.

Figure 3:
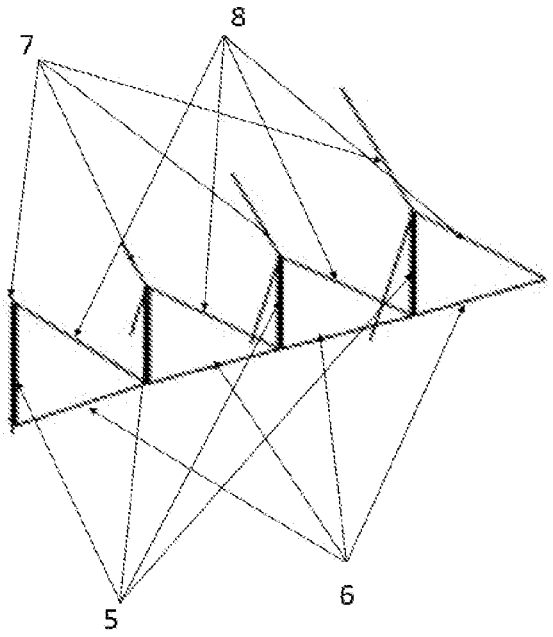
FIG. 3 illustrates a schematic structural diagram of the structure at a position A in FIG. 2.

As shown in FIG. 3, the radial rib unit includes multiple back cables 6 which are sequentially connected with the bottom end of the inner ring rod and located in the same straight line. The back cables 6 are located in a radial direction of a ring surrounded by the bottom ends of the inner ring rods, and each back cable 6 is provided with a strut 5 at an end facing away from the inner ring rod. The bottom end of the strut 5 is fixedly connected with the back cable 6. Two adjacent struts 5 in the same radial rib unit are connected through a diagonal cable 8, and the top end of the inner ring rod is connected with the bottom end of the strut 5 closest to the inner ring rod through a diagonal cable 8.

In two adjacent struts 5 of the same radial rib unit, the top end of the strut 5 closer to the inner strut ring 4 is connected with an end of the diagonal cable 8, and the bottom end of the strut 5 farther away from the inner strut ring 4 is connected with another end of the diagonal cable 8. The distance between two adjacent struts 5 in the same radial rib unit increases outward from the inner strut ring 4, and the length of the struts 5 in the same radial rib unit increases outward from the inner strut ring 4. The top ends of the struts 5 in all radial rib units fall on the same paraboloid, and the top ends of the struts 5 on the same circumference in all radial rib units are connected in series through the hoop cables 7.

Figure 4:
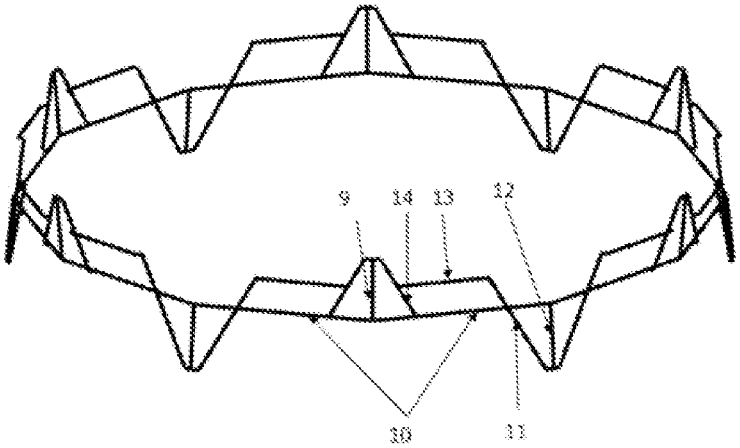
FIG. 4 illustrates a schematic structural diagram of a deployable truss structure of the deployable mesh antenna based on dome-type tensegrity according to an embodiment of the disclosure.

As shown in FIG. 4, the peripheral deployable truss 3 includes an annular main rod 10 and multiple truss units disposed on the main rod 10, and the truss units are connected end to end.

Figure 5:
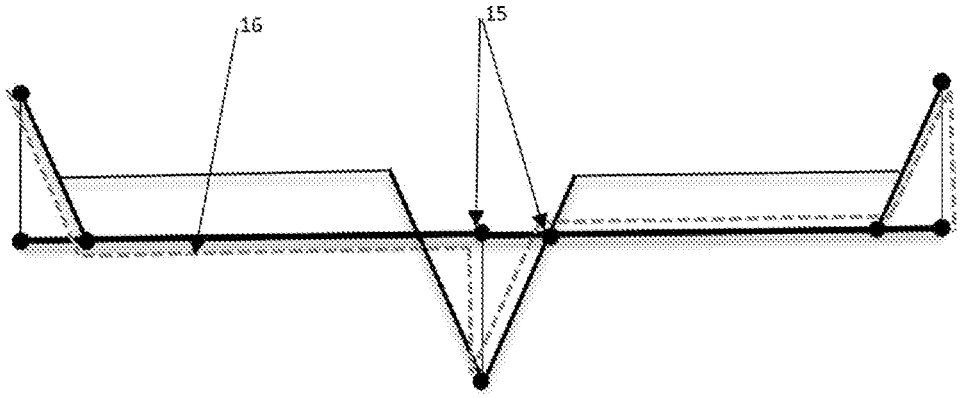
FIG. 5 illustrates a schematic diagram of a cable threading mode of a truss unit according to an embodiment of the disclosure.

As shown in FIG. 5, the truss unit includes a retractable lower sleeve rod 12 connected with the main rod 10, and further includes a left half unit and a right half unit which take the retractable lower sleeve rod 12 as an axis and are in an axisymmetric structure. The left half unit includes a retractable upper sleeve rod 9, an upper auxiliary rod 14, a connecting rod 13 and a lower auxiliary rod 11 which are connected in sequence. Two ends of the retractable upper sleeve rod 9 are respectively hinged with an end of the upper auxiliary rod 14 and the main rod 10, and another end of the upper auxiliary rod 14 is hinged with the main rod 10. Two ends of the retractable lower sleeve rod 12 are respectively hinged with the main rod 10 and an end of the lower auxiliary rod 11, an end of the connecting rod 13 is hinged with a middle of the upper auxiliary rod 14, a position of one third of a length of the lower auxiliary rod 11 is hinged with the main rod 10. The retractable upper sleeve rod 9 and the retractable lower sleeve rod 12 are retractable sleeve rod structures with adjustable lengths, and the retractable upper sleeve rod 9 and the retractable lower sleeve rod 12 are located on upper and lower sides of the main rod 10 respectively. The retractable upper sleeve rod 9 and the retractable lower sleeve rod 12 are both parallel to the strut 5. The upper auxiliary rod 14 of the left half unit is hinged with the upper auxiliary rod 14 of the right half unit in the adjacent truss unit, the retractable upper sleeve rods 9 connected by the two hinged upper auxiliary rods 14 are the same retractable upper sleeve rod 9, and the hinged positions of the two hinged upper auxiliary rods 14 and the retractable upper sleeve rod 9 are the same hinge point.

Figure 6:
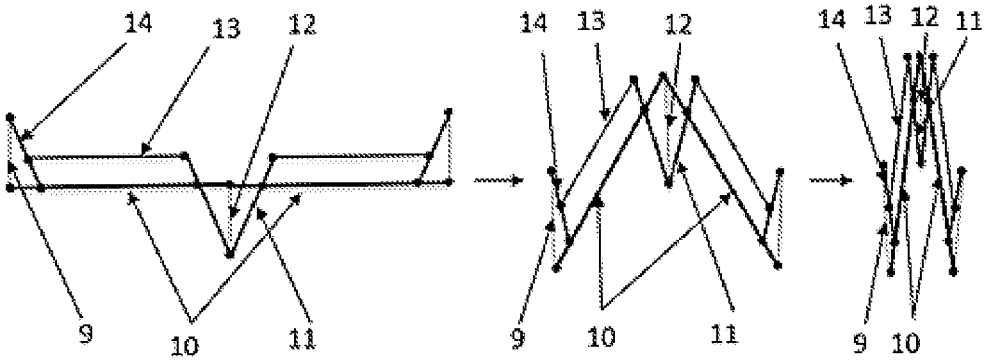
FIG. 6 illustrates a schematic diagram of a folding process of the truss unit according to an embodiment of the disclosure.

The peripheral deployable truss 3 is provided with a driving cable 16, which passes through the truss units individually. In the left half unit of each truss unit, a connection position of the retractable upper sleeve rod 9 and the main rod 10, a connection position of the retractable upper sleeve rod 9 and the upper auxiliary rod 14, a connection position of the upper auxiliary rod 14 and the main rod 10, a connection position of the retractable lower sleeve rod 12 and the main rod 10, and a connection position of the retractable lower sleeve rod 12 and the lower auxiliary rod 11 are respectively provided with fixed pulleys 15. In the right half unit of each truss unit, a connection position of the retractable upper sleeve rod 9 and the main rod 10, a connection position of the retractable upper sleeve rod 9 and the upper auxiliary rod 14, a connection position of the upper auxiliary rod 14 and the main rod 10, and a connection position of the lower auxiliary rod 11 and the main rod 10 are respectively provided with fixed pulleys 15. The driving cable 16 passes through the upper auxiliary rod 14 and sequentially bypass all fixed pulleys 15 of the truss unit. The driving cable 16 is set in the same way in each truss unit, and two ends of the driving cable 16 are connected with a motor. As shown in FIG. 6, it is a schematic diagram of the folding process of the truss unit.

Figure 7:
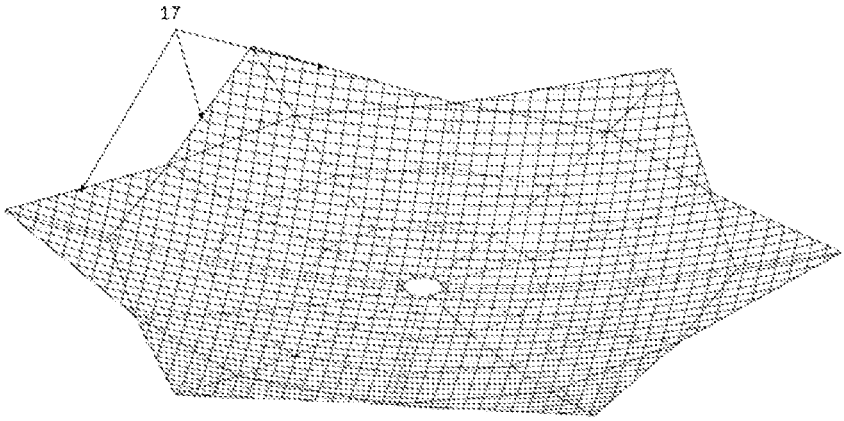
FIG. 7 illustrates a schematic structural diagram of a wire mesh reflector of the deployable mesh antenna based on dome-type tensegrity according to an embodiment of the disclosure.

The wire mesh reflector 1 covers the dome-type reflector support system 2. On the one hand the wire mesh reflector 1 is connected with the cable of the dome-type reflector support system 2, on the other hand, the wire mesh reflector 1 is connected with the peripheral deployable truss 3, so as to form a parabolic structure of the antenna and complete the task of reflecting electromagnetic waves. As shown in FIG. 7, the wire mesh reflector 1 covers the dome-type reflector support system 2 to form a parabolic structure, and the wire mesh reflector 1 is petal-shaped and has a grid structure.

The center of the wire mesh reflector 1 is provided with a center opening matching with the inner strut ring 4, and the center opening is fixedly connected with the top ends of the inner ring rods. The grids of the wire mesh reflector 1 are radially distributed around the center opening, and the gird size increases from the center opening to the outer edge of the wire mesh reflector 1, and the gird is an isosceles trapezoid, and the upper and lower bottom edges of the isosceles trapezoid grid are respectively fixed on two adjacent hoop cables 7.

The outer edge of the wire mesh reflector 1 is provided with a tension cable 17, and the tension cable 17 is arranged in a plurality of V-shapes along the outline of the outer edge of the wire mesh reflector 1, and each V-shaped connection point of the tension cable 17 is fixed at a corresponding connection point of two upper auxiliary rods 14 of the peripheral deployable truss 3.

The number of the struts 5 in each radial rib unit is Q, which represents the number of rings formed by the struts 5 in the dome-type reflector support system 2. The number of the radial rib units is N. Q and N are selected according to the surface accuracy RMS of the wire mesh reflector 1 and the overall mass M of the dome-type reflector support system 2, and Q and N are specifically obtained by the following steps.

Step 1, for given design parameters of the deployable mesh antenna: the aperture D, focal length f, surface accuracy RMS and maximum mass $M_{max}$, respectively calculating the surface accuracy of the wire mesh reflector 1 with different ring numbers Q and rib numbers N, and selecting the ring numbers Q and rib numbers N corresponding to the surface accuracy RMS meeting design requirements.

Figure 8:
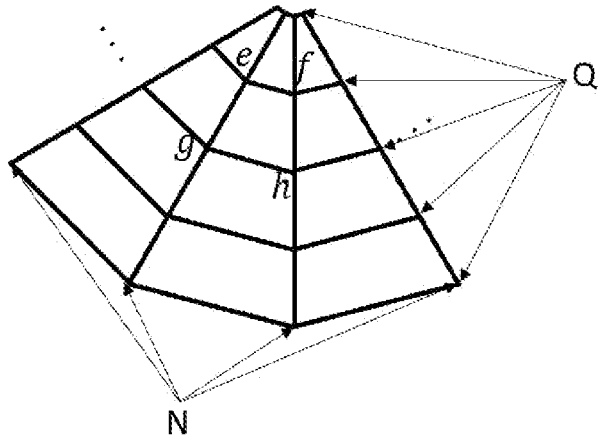
FIG. 8 illustrates a schematic diagram of the deployable mesh antenna based on dome-type tensegrity fitting a trapezoidal patch of antenna paraboloid according to an embodiment of the disclosure.

Specifically, as shown in FIG. 8, the wire mesh reflector 1 of the deployable mesh antenna is fitted by a trapezoidal grid patch efgh, and the plane equation of each trapezoidal grid patch is expressed as $Z_1=aX+bY+c$. Where a, b, c are constant. The standard parabolic equation where the nodes of the dome-type reflector support system 2 are located is expressed as $$Z_2 = \frac{X^2 + Y^2}{4f},$$

thus the RMS error between the paraboloid fitted by trapezoidal grid patch and the ideal paraboloid is expressed by the formula (1) as follows:

$$\delta^2 = \frac{\sum_{i=1}^{K} \iint_{D_{XY}} \left((aX + bY + c) - \left(\frac{X^2 + Y^2}{4f}\right)\right)^2 dxdy}{\sum_{i=1}^{K} A_{D_{XY}}} \tag{1}$$

where in the formula (1), K is the total number of trapezoidal grid patches, $A_{D_{XY}}$ is the projection area of trapezoidal grid patches on the XOY plane.

The formula (1) is used to calculate a set of RMS error values between the ideal paraboloid and the actual reflector corresponding to different ring numbers Q and rib numbers N, and the surface accuracy of the paraboloid antenna is measured by the RMS error values. The smaller the RMS error value, the higher the surface accuracy of the antenna is. The ring numbers Q and rib numbers N corresponding to the surface accuracy that meets the design requirements.

Step 2, respectively calculating the overall mass of the dome-type reflector support system 2 with the ring numbers Q and the rib numbers N selected in step 1, and selecting the ring number Q and the rib number N corresponding to the overall mass M meeting the design requirements (i.e., the ring number Q and the rib number N correspond to the minimum mass), that is, the number Q of the struts 5 in the radial rib unit and the number N of the radial rib units in the deployable mesh antenna are obtained.

Figure 9:
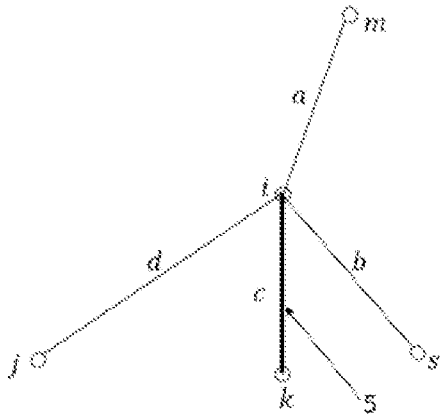
FIG. 9 illustrates a schematic diagram of any unconstrained node in the deployable mesh antenna based on dome-type tensegrity according to an embodiment of the disclosure.

Specifically, as shown in FIG. 9, for any unconstrained node of the dome-type reflector support system 2, the rod c and cables a, b, d are respectively connected the unconstrained node, $x_i$, $y_i$, $z_i$ represents coordinates of this node, $l_a$, $l_b$, $l_c$, $l_d$ represent lengths of the rod and cables of this node, and $T_a$, $T_b$, $T_c$, $T_d$ represents the pretension in the cables and struct. The equilibrium equations are expressed by the formula (2) as followed:

$$\left.\begin{aligned} \frac{x_i - x_m}{l_a}T_a + \frac{x_i - x_s}{l_b}T_b + \frac{x_i - x_k}{l_c}T_c + \frac{x_i - x_j}{l_d}T_d = 0, \\ \frac{y_i - y_m}{l_a}T_a + \frac{y_i - y_s}{l_b}T_b + \frac{y_i - y_k}{l_c}T_c + \frac{y_i - y_j}{l_d}T_d = 0, \\ \frac{z_i - z_m}{l_a}T_a + \frac{z_i - z_s}{l_b}T_b + \frac{z_i - z_k}{l_c}T_c + \frac{z_i - z_j}{l_d}T_d = 0. \end{aligned}\right\} \tag{2}$$

Figure 10:
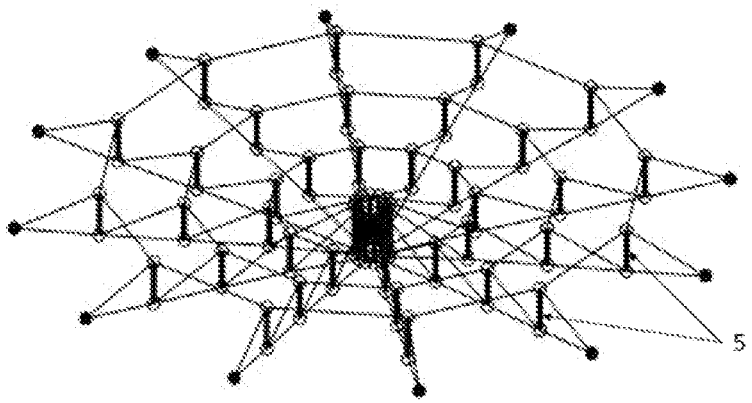
FIG. 10 illustrates a schematic diagram of constrained nodes and unconstrained nodes in the deployable mesh antenna based on dome-type tensegrity according to an embodiment of the disclosure.

As shown in FIG. 10, each hollow circle of the dome-type reflector support system 2 represents an unconstrained node of the structure, and the solid circle of the dome-type reflector support system 2 represents a constrained node. Assuming that there are S unconstrained nodes, W cables and rods in the dome-type reflector support system 2, and the equilibrium equations of formula (2) is listed for each unconstrained node in the structural system, and the following formula (3) is obtained by using H to represent the balance matrix of the structure and using T to represent the pretension vector of the structure:

$$H_{3S\times W}T_{W\times 1}=0_{3S\times 1} \tag{3}$$

By solving the formula (3), the pretension distribution $T_{W\times 1}$ in the cable-strut tension system is obtained. Let the tensile and compressive strength of the material be $\sigma_b$, the safety factor be n, the allowable stress be $[\sigma_b]=\sigma_b/n$, the cross-sectional area of the i-th rod or cable be $A_i$, the length be $l_i$, and the density of the material be $\rho_i$, the formulas (4) and (5) can be obtained:

$$A_i = \frac{T_i}{[\sigma_b]} \tag{4}$$

$$M = \sum_{i=1}^{W} A_i l_i \rho_i \tag{5}$$

The overall mass of the structure under the ring number Q and rib number N is obtained from the formulas (4) and (5). Compared with the mass required by the design, the ring number Q and rib number N that meet the mass requirements are selected, that is, the number Q of the struts 5 and the number N of radial rib units in the deployable mesh antenna are obtained.

The working principle of the deployable mesh antenna based on dome-type tensegrity is as follows.

The peripheral deployable truss 3 is stowed at the initial state. At this time, the dome-type reflector support system 2 inside the antenna is relaxed without pretension, and the dome-type reflector support system 2 and the wire mesh reflector 1 are stowed inside the peripheral deployable truss 3.

After the antenna is launched into orbit, the motor drives the driving cable 16 inside the peripheral deployable truss 3 and provides the driving force for the deployment of the peripheral deployable truss 3 to drive the deployment of the peripheral deployable truss 3. After the peripheral deployable truss 3 is deployed in place, the driving cable 16 is locked by the motor, and the peripheral deployable truss 3 is locked by a lock assembly at this time. The dome-type tensegrity structure is shaped and produces structural rigidity under the supporting of the peripheral deployable truss 3 and supports the wire mesh reflector 1 to form a predetermined paraboloid shape, and the antenna structure enters the working state.

What is claimed is:

1. A deployable mesh antenna based on dome-type tensegrity, comprising: a wire mesh reflector, a dome-type reflector support system, and a peripheral deployable truss which are coaxially arranged;

wherein the peripheral deployable truss comprises: an annular main rod and a plurality of truss units disposed on the main rod, and the plurality of truss units are connected end to end;

wherein an outermost cable boundary of the dome-type reflector support system is fixedly connected to the peripheral deployable truss, the dome-type reflector support system comprises: an inner strut ring and a plurality of radial rib units connected to an outer circumference of the inner strut ring, each of the plurality of radial rib units is arranged at a radial direction of the inner strut ring, and the plurality of radial rib units are connected through hoop cables;

wherein the wire mesh reflector is covered on the dome-type reflector support system to form a parabolic structure, the wire mesh reflector is petal-shaped and has a grid structure;

wherein the inner strut ring comprises a plurality of inner ring rods parallel to one another and distributed in a circular shape, top ends of the plurality of inner ring rods are connected in series through a cable, and bottom ends of the plurality of inner ring rods are connected in series through a cable;

wherein each radial rib unit comprises a plurality of back cables arranged at a same straight line, the plurality of back cables are sequentially connected with the bottom end of a corresponding one of the plurality of inner ring rods, the plurality of back cables are located at a radial direction of a ring surrounded by the bottom ends of the plurality of inner ring rods; an end of each back cable facing away from the corresponding inner ring rod is provided with a strut, a bottom end of the strut is fixedly connected to the back cable, and two adjacent struts in the same radial rib unit are connected through a diagonal cable, and the top end of the inner ring rod and the bottom end of the strut closest to the inner ring rod are connected through a diagonal cable;

wherein in the two adjacent struts of the same radial rib unit, a top end of the strut closer to the inner strut ring is connected with an end of the diagonal cable, and the bottom end of the strut farther away from the inner strut ring is connected with another end of the diagonal cable;

wherein a distance between the two adjacent struts in the same radial rib unit increases outward from the inner strut ring, and a length of the strut in the same radial rib unit increases outward from the inner strut ring, the top ends of the struts in the plurality of radial rib units fall on a same paraboloid, and the top ends of the struts located on a same circumference in the plurality of radial rib units are connected in series by the hoop cable;

wherein each truss unit comprises a retractable lower sleeve rod connected with the main rod, and further comprises a left half unit and a right half unit which take the retractable lower sleeve rod as an axis and are in an axisymmetric structure; the left half unit comprises a retractable upper sleeve rod, an upper auxiliary rod, a connecting rod and a lower auxiliary rod connected sequentially in that order; two ends of the retractable upper sleeve rod are respectively hinged with an end of the upper auxiliary rod and the main rod, another end of the upper auxiliary rod is hinged with the main rod, two ends of the retractable lower sleeve rod are respectively hinged with the main rod and an end of the lower auxiliary rod, an end of the connecting rod is hinged on a middle of the upper auxiliary rod, another end of the lower auxiliary rod is hinged with another end of the connecting rod, a position of one third of a length of the lower auxiliary rod is hinged with the main rod, the retractable upper sleeve rod and the retractable lower sleeve rod are located on upper and lower sides of the main rod, and the retractable upper sleeve rod and the retractable lower sleeve rod are parallel to the strut, the upper auxiliary rod of the left half unit is hinged with the upper auxiliary rod of the right half unit in the adjacent truss unit; the retractable upper sleeve rods connected by the two hinged upper auxiliary rods is the same retractable upper sleeve rod, and hinged positions of the two hinged upper auxiliary rods and the retractable upper sleeve rod are the same hinged point;

wherein the peripheral deployable truss is provided with a driving cable passing through the plurality of truss units individually; in the left half unit of each truss unit, a connection position of the retractable upper sleeve rod and the main rod, a connection position of the retractable upper sleeve rod and the upper auxiliary rod, a connection position of the upper auxiliary rod and the main rod, a connection position of the retractable lower sleeve rod and the main rod, and a connection position of the retractable lower sleeve rod and the lower auxiliary rod are respectively provided with fixed pulleys, and the driving cable passes through the upper auxiliary rod and successively bypasses the fixed pulleys of the truss unit; in the right half unit of each truss unit, a connection position of the retractable upper sleeve rod and the main rod, a connection position of the retractable upper sleeve rod and the upper auxiliary rod, a connection position of the upper auxiliary rod and the main rod, and a connection position of the lower auxiliary rod and the main rod are respectively provided with fixed pulleys, and the driving cable is set in a same way in the plurality of truss units; and two ends of the driving cable are connected to a motor;

wherein a center of the wire mesh reflector is provided with a center opening matching with the inner strut ring, the center opening is fixed connected with the top ends of the plurality of inner ring rods, grids of the wire mesh reflector are radially distributed around the center opening, and sizes of the grids increase from the center opening to an outer edge of the wire mesh reflector, and each grid is an isosceles trapezoid, and upper and lower bottom edges of the isosceles trapezoid grid are respectively fixed on two adjacent hoop cables; and wherein the outer edge of the wire mesh reflector is provided with a tension cable, the tension cable is arranged in multiple V-shapes, the multiple V-shapes are sequentially connected along an outline of the outer edge of the wire mesh reflector, and a V-shaped connection point of each V-shape of the tension cable is fixed at a connection point of the two upper auxiliary rods of the peripheral deployable truss.

2. The deployable mesh antenna based on dome-type tensegrity according to claim 1, wherein the number of the struts in each radial rib unit is Q, Q represents the number of rings formed by the struts in the dome-type reflector support system, the number of the plurality of radial rib units is N; and Q and N are selected according to a surface accuracy root-mean-square (RMS) of the wire mesh reflector and an overall mass M of the dome-type reflector support system, and Q and N are specifically obtained through the following steps:

step 1, for given design parameters of the deployable mesh antenna: an aperture D, a focal length f, and a surface accuracy RMS, calculating a profile precision of the wire mesh reflector under different ring numbers and different rib numbers, and selecting the ring numbers and the rib numbers corresponding to the surface accuracy RMS meeting design requirements; and step 2, calculating overall mass of the dome-type reflector support system under the selected ring numbers and the selected rib numbers in step 1, and selecting the ring number Q and the rib number N corresponding to the overall mass meeting design requirements, which are the number of the struts in each radial rib unit and the number of the plurality of radial rib units in the deployable mesh antenna.

* * * * *